US009969050B1

(12) United States Patent
Zhao et al.

(10) Patent No.: US 9,969,050 B1
(45) Date of Patent: May 15, 2018

(54) GRINDING HEAD AND GRINDING DEVICE

(71) Applicants: BOE TECHNOLOGY GROUP CO., LTD., Beijing (CN); BEIJING BOE DISPLAY TECHNOLOGY CO., LTD, Beijing (CN)

(72) Inventors: Wei Zhao, Beijing (CN); Hongtao Ma, Beijing (CN); Lizhu Yu, Beijing (CN); Peng Di, Beijing (CN); Jingxiao Lan, Beijing (CN); Guodong Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days. days.

(21) Appl. No.: 15/521,027

(22) PCT Filed: Oct. 21, 2016

(86) PCT No.: PCT/CN2016/102791

§ 371 (c)(1),
(2) Date: Apr. 21, 2017

(87) PCT Pub. No.: WO2017/118144

PCT Pub. Date: Jul. 13, 2017

(30) Foreign Application Priority Data

Jan. 5, 2016 (CN) ..... 2016 1 0007077

(51) Int. Cl.
*B24B 41/047* (2006.01)
*B24B 41/053* (2006.01)

(52) U.S. Cl.
CPC ..... *B24B 41/053* (2013.01)

(58) Field of Classification Search
CPC .. B24B 5/053; B24B 7/17; B24B 7/16; B24B 37/04; B24B 37/30; G11B 5/8404
(Continued)

(56) References Cited

U.S. PATENT DOCUMENTS 2,264,177 A 11/1941 Harrington
5,161,332 A * 11/1992 Koch ..... B24B 19/06 451/247

(Continued)

FOREIGN PATENT DOCUMENTS

CN 1445058 A 10/2003
CN 101444898 A 6/2009

(Continued)

OTHER PUBLICATIONS

Office Action in Chinese Application No. 201610007077.0 dated May 27, 2017, with English translation.

(Continued)

*Primary Examiner* — George Nguyen
(74) *Attorney, Agent, or Firm* — Womble Bond Dickinson (US) LLP

(57) ABSTRACT

A grinding head includes: a guide rail; a first grinding assembly and a second grinding assembly which are located at two ends of the guide rail respectively and can move along the guide rail; and a number of filling assemblies, which are disposed between the first grinding assembly and the second grinding assembly, wherein dimensions and/or quantity of the filling assemblies are based on a width between the first grinding assembly and the second grinding assembly, wherein the filling assemblies can cooperate with the first grinding assembly and the second grinding assembly to form an entire grinding bottom face. The width of the bottom face of the grinding head can be adjusted so that the waste of grinding cloth due to grinding a thin display is panel surface (Continued)

by a grinding head with a wide bottom face can be avoided and the operating efficiency can be enhanced.

16 Claims, 2 Drawing Sheets

(58) Field of Classification Search
USPC ..... 451/164, 65
See application file for complete search history.

(56) References Cited

U.S. PATENT DOCUMENTS

| | | | | |
|---|---|---|---|---|
| 5,707,274 | A * | 1/1998 | Kim | B24B 37/04 257/E21.237 |
| 5,860,847 | A * | 1/1999 | Sakurai | B24B 37/013 257/E21.528 |
| 5,951,379 | A * | 9/1999 | Palmer | B23Q 7/1468 451/182 |
| 6,220,927 | B1 * | 4/2001 | Mizuno | B24B 9/14 451/10 |
| 6,247,999 | B1 * | 6/2001 | Tokiwa | B24B 19/20 451/57 |
| 6,402,588 | B1 * | 6/2002 | Matsuo | B24B 7/228 451/21 |
| 6,413,152 | B1 * | 7/2002 | Sengupta | B24B 27/0076 451/287 |
| 7,144,304 | B2 * | 12/2006 | Moore | B24B 21/04 451/41 |
| 8,348,720 | B1 * | 1/2013 | Ko | B24B 37/042 451/285 |
| 2003/0181149 | A1 | 9/2003 | Shin | |
| 2004/0162688 | A1 * | 8/2004 | Eaton | B24B 37/04 702/100 |
| 2009/0291623 | A1 | 11/2009 | Masumura et al. | |
| 2012/0028545 | A1 * | 2/2012 | Duescher | B24B 37/04 451/28 |

FOREIGN PATENT DOCUMENTS

| | | | |
|---|---|---|---|
| CN | 101528416 | A | 9/2009 |
| CN | 102528608 | A | 7/2012 |
| CN | 102528644 | A | 7/2012 |
| CN | 202726720 | U | 2/2013 |
| CN | 103692341 | A | 4/2014 |
| CN | 203723409 | U | 7/2014 |
| CN | 203765463 | U | 8/2014 |
| CN | 203875751 | U | 10/2014 |
| CN | 204262969 | U | 4/2015 |
| CN | 102554758 | B | 6/2016 |
| CN | 105619243 | A | 6/2016 |
| FR | 534221 | A | 3/1922 |
| JP | 2009297865 | A | 12/2009 |

OTHER PUBLICATIONS

International Search Report and Written Opinion in PCT/CN2016/102791 dated Jan. 20, 2017, with English translation.

* cited by examiner

GRINDING HEAD AND GRINDING DEVICE

RELATED APPLICATIONS

The present application claims the benefit of a Chinese Patent Application No. 201610007077.0, filed on Jan. 5, 2016, the entire disclosure of which is incorporated herein by reference.

FIELD OF THE DISCLOSURE

The present disclosure relates to a technical field of display panel cleaning, and in particular relates to a grinding head and a grinding device.

BACKGROUND OF THE DISCLOSURE

Thin film transistor-liquid crystal displays (TFT-LCDs) have the features such as a thin profile, low power consumption, no radiation, and so on, and have developed rapidly in recent years and have prevailed in the flat panel display market.

Currently, in the manufacture process of a TFT-LCD, a liquid crystal display panel should be cleaned before attaching a polarizer. In the prior art, a commonly used cleaning method is to grind a panel surface by a grind head with fixed size (as shown in FIG. 1) so as to remove glass debris on the panel surface. However, the grinding head with fixed size has the following shortcomings:

1. because the sizes of panels are various, when the size of the panel is changed, the grinding head should be changed or the grinding trajectory should be adjusted and verified in order to grind every position on the panel, which will increase downtime.

2. if the grinding head is large relative to the panel size, the grinding cloth can easily operate beyond the panel, leading to the waste of grinding cloth and reducing the utilization rate of the grinding cloth; if the grinding head is small relative to the panel size, the grinding efficiency will be lowered and therefore the production efficiency will be lowered.

SUMMARY OF THE DISCLOSURE

In light of the above problems in the prior art grinding head, a technical problem to be solved by the present disclosure is to provide a grinding head and a grinding device with an adjustable grinding width which can avoid the waste of grinding cloth and improve production efficiency.

To solve the technical problem, the present disclosure provides a grinding head comprising:

a guide rail;

a first grinding assembly and a second grinding assembly which are located at two ends of the guide rail respectively and can move along the guide rail; and a plurality of filling assemblies, which are disposed between the first grinding assembly and the second grinding assembly, and the dimensions and/or the quantity of the filling assemblies are based on a width between the first grinding assembly and the second grinding assembly, wherein the filling assemblies can cooperate with the first grinding assembly and the second grinding assembly to form an entire grinding bottom face.

According to an aspect of the present disclosure, each of the first grinding assembly and the second grinding assembly comprises: a moving component which can move along the guide rail; and a grinding component which is located under the moving component and is connected with the moving component.

According to an aspect of the present disclosure, the opposing ends of the grinding component of the first grinding assembly and the grinding component of the second grinding assembly are provided with first sawtooth structures; two ends of each filling assembly are provided with second sawtooth structures cooperating with the first sawtooth structures; during assembling, the first sawtooth structures and the second sawtooth structures can be fixedly connected to each other.

According to an aspect of the present disclosure, the grinding head further comprises first fixing bolts; the sawteeth of each of the first sawtooth structures and the second sawtooth structures are provided with through holes; during assembling, the first fixing bolts are inserted into the through holes so that the filling assemblies can be fixed between the grinding component of the first grinding assembly and the grinding component of the second grinding assembly.

According to an aspect of the present disclosure, the first sawtooth structure of the grinding component of the first grinding assembly and the first sawtooth structure of the grinding component of the second grinding assembly can cooperate with each other and can be fixedly connected to each other during assembling.

According to an aspect of the present disclosure, the grinding head further comprises second fixing bolts; the guide rail and the moving components are both provided with through holes; and during assembling, the second fixing bolts are inserted into the through holes so that the moving components can be fixed to the guide rail.

According to an aspect of the present disclosure, the grinding component of the first grinding assembly and the grinding component of the second grinding assembly are both provided with pressure sensors which are used to detect the pressures on the grinding component of the first grinding assembly and the grinding component of the second grinding assembly during grinding.

According to an aspect of the present disclosure, the grinding head further comprises a comparison unit and an alarm unit; wherein;

the comparison unit is configured to compare the pressure values sensed by the pressure sensors of the grinding component of the first grinding assembly and the grinding component of the second grinding assembly with a first preset value; when a pressure value sensed by at least one pressure sensor is higher than the first preset value, the comparison unit can send a first alarm signal to the alarm unit;

The alarm unit is configured alarm to prompt the user when receiving the first alarm signal.

According to an aspect of the present disclosure, the grinding head further comprises a calculation unit, wherein:

the calculation unit is configured to calculate a difference between the pressure values sensed by the pressure sensors of the grinding component of the first grinding assembly and the grinding component of the second grinding assembly;

the comparison unit is further configured to compare the difference with a second preset value, and when the difference is higher than the second preset value, the comparison unit sends a second alarm signal to the alarm unit;

The alarm unit can alarm to prompt the user when receiving the second alarm signal.

According to an aspect of the present disclosure, the grinding head further comprises a rotating assembly located above the guide rail which is used to drive the guide rail to rotate under an action of a motor during grinding.

According to an aspect of the present disclosure, on the entire grinding bottom face formed by the filling assemblies, the first grinding assembly and the second grinding assembly cooperating with each other, there is provided with a grinding cloth for grinding a liquid crystal panel.

The present disclosure further provides a grinding device comprising the above grinding head.

When various display panels with different sizes are ground by the grinding head of the present disclosure, the width of the bottom face of the grinding head can be adjusted. Specifically, when a display panel with a small size is ground, the width of the bottom face can be adjusted to be narrower, so that the waste of grinding cloth caused by grinding the thin display panel surface by a grinding head with a wide bottom face can be avoided. When a larger display panel is ground, the width of the bottom face can be adjusted to be wider so as to enhance operating efficiency.

DETAILED DESCRIPTION OF THE DISCLOSURE

The present disclosure will be further described in detail in conjunction with the drawings and the embodiments in order to facilitate those skilled in the art to better understand the technical solution of the present disclosure.

Figure 1:
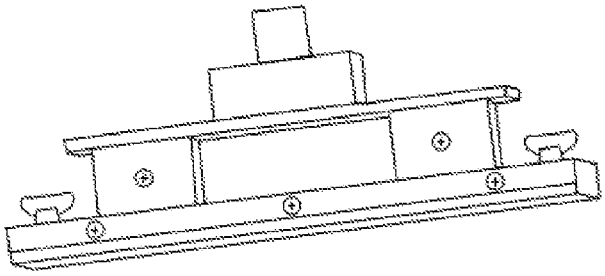
FIG. 1 is a schematic view showing a grinding head in prior art.
Figure 2:
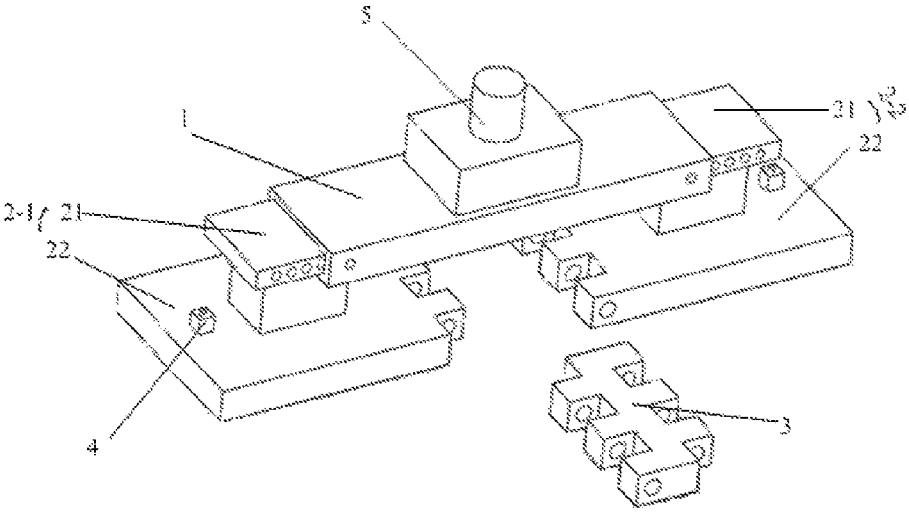
FIG. 2 is a schematic structure view showing a grinding head according to an embodiment of the present disclosure.
Figure 3:
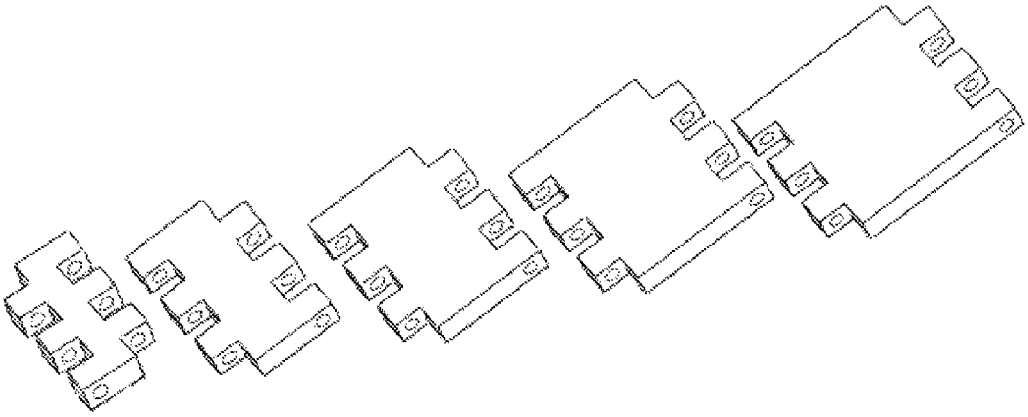
FIG. 3 is a schematic view showing various filling assemblies with different sizes which can be used in the grinding head shown in the embodiment of FIG. 2.

Referring to FIGS. 2-3, an embodiment of the present disclosure provides a grinding head comprising a guide rail 1; a first grinding assembly 2-1 and a second grinding assembly 2-2 which are located at two ends of the guide rail 1 respectively and can move along the guide rail 1; and a plurality of filling assemblies 3 with different sizes (as shown in FIG. 3), which are disposed between the first grinding assembly 2-1 and the second grinding assembly 2-2. The dimensions and/or the quantity of the filling assemblies 3 are based on the width between the first grinding assembly 2-1 and the second grinding assembly 2-2, wherein the filling assemblies 3 can cooperate with the first grinding assembly 2-1 and the second grinding assembly 2-2 to form an entire grinding bottom face (the bottom face is an operating surface for grinding) for grinding an upper face of a display panel and removing glass debris on the display panel surface.

Because in the grinding head of the present embodiment, the first grinding assembly 2-1 and the second grinding assembly 2-2 can move along the guide rail 1, the width between the first grinding assembly 2-1 and the second grinding assembly 2-2 can be adjusted, and then in conjunction with the filling assemblies 3 having respective widths, they can cooperate to realize various bottom faces with different widths. In this way, when grinding various display panels with different dimensions, the width of the bottom face of the grinding head can be adjusted. Specifically, when grinding a display panel with a small dimension, the width of the bottom face can be adjusted to be narrower, so that the waste of grinding cloth caused by grinding a thin display panel surface by a grinding head with a wide bottom face can be avoided. When a larger display panel is ground, the width of the bottom face can be adjusted to be wider so as to enhance operating efficiency.

Wherein each of the first grinding assembly 2-1 and the second grinding assembly 2-2 comprises: a moving component 21 which can move along the guide rail 1; and a grinding component 22 which is located under the moving component 21 and is connected with the moving component 21. The moving components 21 of the first grinding assembly 2-1 and the second grinding assembly 2-2 and respective connected grinding components 22 can be integrally molded. Of course, those components can be separately manufactured and then connected together by welding, bolt and the like.

As an example of the present application, the opposing ends of the grinding component 22 of the first grinding assembly 2-1 and the grinding component 22 of the second grinding assembly 2-2 are provided with first sawtooth structures; the two ends of each filling assembly 3 are provided with second sawtooth structures cooperating with the first sawtooth structures; during assembling, the first sawtooth structures and the second sawtooth structures can be fixedly connected to each other to form the entire grinding bottom face for grinding.

Figure 4:
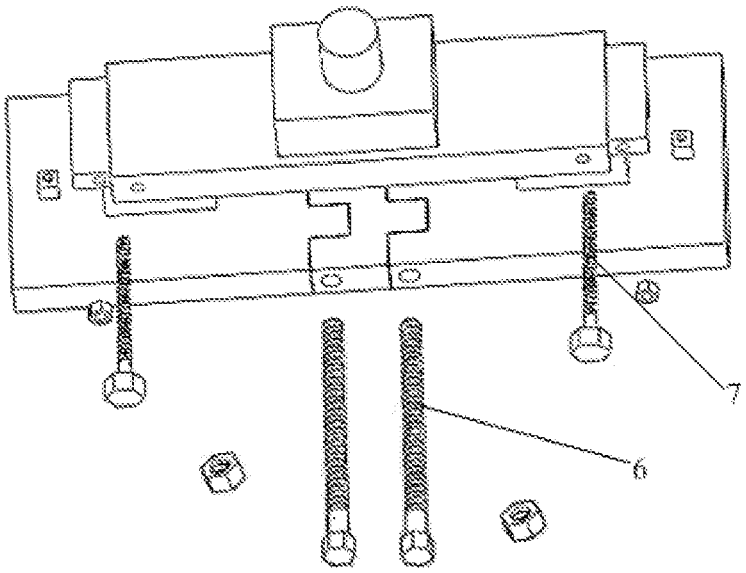
FIG. 4-FIG. 5 shows how to assemble filling assemblies in the grinding head according to an embodiment of the present disclosure.
Figure 5:
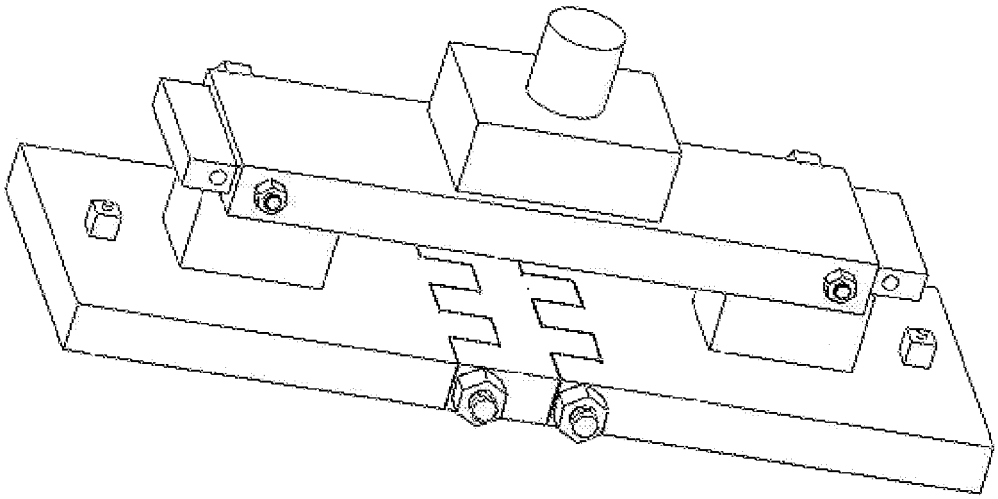

That is to say, convex portions of the first sawtooth structure of the grinding component 22 of the first grinding assembly 2-1 can engage concave portions of the second sawtooth structures at an end of the filling assembly 3 near the first sawtooth structure. In the same way, convex portions of the first sawtooth structure of the grinding component 22 of the second grinding assembly 2-2 can engage concave portions of respective second sawtooth structure. As shown in FIG. 4 and FIG. 5, during assembling, the first sawtooth structure can be fixedly connected with the second sawtooth structure, and the first sawtooth structure and the second sawtooth structure can be fixed together by first fixing bolts 6. Specifically, the sawteeth (convex portions) of each of the first sawtooth structure and the second sawtooth structure are provided with through holes; during assembling, the first fixing bolts 6 can be inserted into the through holes so that the filling assemblies 3 can be fixed between the grinding component 22 of the first grinding assembly 2-1 and the grinding component 22 of the second grinding assembly 2-2.

As another example of the present application, the filling assemblies 3 can be omitted. That is to say, the first sawtooth structures of the grinding components 22 of the first grinding aassembly 2-1 and the first sawtooth structures of the grinding components 22 of the second grinding assembly 2-2 can cooperate with each other directly and can be fixedly connected to each other during assembling. That is, the convex portions of the first sawtooth structure of the grinding component 22 of the first grinding assembly 2-1 can match the concave portions of the first sawtooth structure of the grinding component 22 of the second grinding assembly 2-2. Therefore, when the widths of the first grinding assembly 2-1 and the second grinding component 22 can exactly fit the display panel to be ground, the first sawtooth structure of the grinding component 22 of the first grinding assembly 2-1 and the first sawtooth structure of the grinding component 22 of the second grinding assembly 2-2 can engage with each other directly, without additionally providing the filling assemblies 3. Specifically, the sawteeh (convex portions) of the first sawtooth structures of the two grinding components 22 are provided with through holes; and during assembling, the first fixing bolts 6 can be inserted into the through holes so that the grinding component 22 of the first grinding assembly 2-1 and the grinding component 22 of the second grinding assembly 2-2 can be fixed together.

As another example of the present application, the grinding head further comprises second fixing bolts 7; the guide rail 1 and the moving components 21 are both provided with through holes; and during assembling, the second fixing bolts 7 can be inserted into the through holes so that the moving components 21 can be fixed to the guide rail 1.

The reason for fixing the guide rail 1 and the moving components 21 by the second fixing bolts 7 is that the first grinding assembly 2-1 and the second grinding assembly 2-2 can move along the guide rail 1, if the moving components 21 of the first grinding assembly 2-1 and the second grinding assembly 2-2 are not fixed to the guide rail 1, during grinding, the width between the first grinding assembly 2-1 and the second grinding assembly 2-2 can easily change, resulting poor grinding and thereby affecting the yield of the display panel.

As another example of the present application, the grinding component 22 of the first grinding assembly 2-1 and the grinding component 22 of the second grinding assembly 2-2 are both provided with pressure sensors 4 which are used to detect the pressures on the grinding component 22 of the first grinding assembly 2-1 and the grinding component 22 of the second grinding assembly 2-2 during grinding.

The grinding head further comprises a comparison unit, a calculation unit and an alarm unit (not shown); wherein: the comparison unit is configured to compare the pressure values sensed by the pressure sensors 4 on the grinding component 22 of the first grinding assembly 2-1 and the grinding component 22 of the second grinding assembly 2-2 with a first preset value; when a pressure value sensed by at least one pressure sensor is higher than the first preset value, the comparison unit can send a first alarm signal to the alarm unit; the alarm unit is configured to alarm to prompt the user when receiving the first alarm signal. The calculation unit is configured to calculate difference between the pressure values sensed by the pressure sensors 4 on the grinding component 22 of the first grinding assembly 2-1 and the grinding component 22 of the second grinding assembly 2-2; the comparison unit is configured to compare the difference with a second preset value, and when the difference value is higher than the second preset value, the comparison unit sends a second alarm signal to the alarm unit; and the alarm unit is configured to alarm to prompt the user when receiving the second alarm signal.

The grinding head of the present embodiment comprises pressure sensors 4, a comparison unit, a calculation unit, an alarm unit, which make the grinding head more intelligent and can effectively prevent overpressure on the first grinding assembly 2-1 and the second grinding assembly 2-2 and scratches on the display panel surface.

As an example of the present application, the grinding head of the present embodiment further comprises a rotating assembly 5 located above the guide rail 1 which is used to drive the guide rail 1 to rotate under the action of a motor during grinding. This part can be the same as the structure in the prior art. In the grinding process, it can drive the grinding head to rotate while grinding. Of course, on the entire bottom face formed by the filling assemblies 3 and the first grinding assembly 2-1 and the second grinding assembly 2-2 cooperating with each other, there is also provided with a grinding cloth for grinding a panel.

In summary, when various display panels with different sizes are ground by the grinding head of the present disclosure, the width of the bottom face of the grinding head can be adjusted. Specifically, when a display panel with small size is ground, the width of the bottom face can be adjusted to be narrower, so that the waste of grinding cloth caused by grinding the thin display panel surface by means of a grinding head with a wide bottom face can be avoided. When a larger display panel is ground, the width of the bottom face can be adjusted to be wider so as to enhance operating efficiency.

Furthermore, the present disclosure also provides a grinding device comprising the above grinding head.

As a development, the movable connecting method between the first grinding assembly 2-1 and the second grinding assembly 2-2 on the one hand and the guide rail 1 on the other hand is not limited to a sliding fit. It can also be a rolling fit. For example, the sliding fit can become a rolling fit by using ball bearings. Moreover, it can also employ a complicated electric driven fitting mode. For example, it can employ a fitting mode in the form of gear-rack driven by an electric motor, or it can employ a fitting mode in the form of fluid cylinder-guide bar driven by fluid.

Similarly, the matching between the grinding components 22 of the first grinding assembly 2-1 and the second grinding assembly 2-2 and the fitting between the grinding components 22 and the filling assemblies 3 are not limited to mechanical matching between the convex portions and the concave portions of the sawteeth. As a choice, the grinding components 22 and the filling assemblies 3 can be magnetized and attract each other by magnetic force to form an entire grinding bottom face.

Besides, the grinding head and the grinding device of the present disclosure are not limited to cleaning a liquid crystal display panel, it can also be used to clean surfaces of furnishes and the like that need cleaning.

The above embodiments are only exemplary implementations employed to illustrate the principles of the present disclosure. However, the present disclosure is not limited so. As to those skilled in the art, various modifications and improvements can be made without departing from the spirit and essence of the present disclosure and those modifications and improvements are within the protection scope of the present disclosure.

The invention claimed is:

1. A grinding head, comprising:

a guide rail;

a first grinding assembly and a second grinding assembly which are located at two ends of the guide rail respectively and can move along the guide rail; and a plurality of filling assemblies, which are disposed between the first grinding assembly and the second grinding assembly, wherein dimensions and/or quantity of the filling assemblies are based on a width between the first grinding assembly and the second grinding assembly, and wherein the filling assemblies can cooperate with the first grinding assembly and the second grinding assembly to form an entire grinding bottom face.

2. The grinding head according to claim 1, wherein each of the first grinding assembly and the second grinding assembly comprises: a moving component which can move along the guide rail; and a grinding component which is located under the moving component and is connected with the moving component.

3. The grinding head according to claim 2, wherein opposing ends of the grinding component of the first grinding assembly and the grinding component of the second grinding assembly are provided with first sawtooth structures; two ends of each filling assembly are provided with second sawtooth structures cooperating with the first sawtooth structures; during assembling, the first sawtooth structures and the second sawtooth structures can be fixedly connected to each other.

4. The grinding head according to claim 3, wherein the grinding head further comprises first fixing bolts; the sawteeth of each of the first sawtooth structures and the second sawtooth structures are provided with through holes; during assembling, the first fixing bolts are inserted into the through holes so that the filling assemblies are fixed between the grinding component of the first grinding assembly and the grinding component of the second grinding assembly.

5. The grinding head according to claim 3, wherein the first sawtooth structure of the grinding component of the first grinding assembly and the first sawtooth structure of the grinding component of the second grinding assembly can cooperate with each other and can be fixedly connected to each other during assembling.

6. The grinding head according to claim 2, wherein the grinding head further comprises second fixing bolts; the guide rail and the moving components are both provided with through holes; and during assembling, the second fixing bolts can be inserted into the through holes so that the moving components can be fixed to the guide rail.

7. The grinding head according to claim 2, wherein the grinding component of the first grinding assembly and the grinding component of the second grinding assembly are both provided with pressure sensors which are used to detect pressures on the grinding component of the first grinding assembly and the grinding component of the second grinding assembly during grinding.

8. The grinding head according to claim 7, wherein the grinding head further comprises a comparison unit and an alarm unit; wherein;

the comparison unit is used to compare pressure values sensed by the pressure sensors of the grinding component of the first grinding assembly and the grinding component of the second grinding assembly with a first preset value; when a pressure value sensed by at least one pressure sensor is higher than the first preset value, the comparison unit sends a first alarm signal to the alarm unit;

the alarm unit is configured to alarm to prompt a user when receiving the first alarm signal.

9. The grinding head according to claim 8, wherein the grinding head further comprises a calculation unit, wherein:

the calculation unit is configured to calculate a difference between the pressure values sensed by the pressure sensors of the grinding component of the first grinding assembly and the grinding component of the second grinding assembly;

the comparison unit is further configured to compare the difference with a second preset value, and when the difference is higher than the second preset value, the comparison unit sends a second alarm signal to the alarm unit;

the alarm unit is further configured to alarm to prompt the user when receiving the second alarm signal.

10. The grinding head according to claim 1, wherein the grinding head further comprises a rotating assembly located above the guide rail which is used to drive the guide rail to rotate under an action of a motor during grinding.

11. The grinding head according to claim 1, wherein on the entire grinding bottom face formed by the filling assemblies, the first grinding assembly and the second grinding assembly cooperating with each other, there is provided with a grinding cloth.

12. A grinding device comprising a grinding head according to claim 1.

13. The grinding head according to claim 2, wherein on the entire grinding bottom face formed by the filling assemblies, the first grinding assembly and the second grinding assembly cooperating with each other, there is provided with a grinding cloth.

14. The grinding head according to claim 3, wherein on the entire grinding bottom face formed by the filling assemblies, the first grinding assembly and the second grinding assembly cooperating with each other, there is provided with a grinding cloth.

15. The grinding head according to claim 6, wherein on the entire grinding bottom face formed by the filling assemblies, the first grinding assembly and the second grinding assembly cooperating with each other, there is provided with a grinding cloth.

16. The grinding head according to claim 7, wherein on the entire grinding bottom face formed by the filling assemblies, the first grinding assembly and the second grinding assembly cooperating with each other, there is provided with a grinding cloth.

* * * * *